US007353833B1

(12) United States Patent
Palmer

(10) Patent No.: US 7,353,833 B1
(45) Date of Patent: Apr. 8, 2008

(54) COVERING STRUCTURE WITH SOIL ANCHORS

(76) Inventor: Nanette Palmer, 929 Ockley Dr., Shreveport, LA (US) 71106

( * ) Notice: Subject to any disclaimer, the term of this patent is extended or adjusted under 35 U.S.C. 154(b) by 286 days.

(21) Appl. No.: 11/080,029

(22) Filed: Mar. 15, 2005

(51) Int. Cl.
*E04H 15/62* (2006.01)
*E04H 15/26* (2006.01)
*E04H 15/64* (2006.01)
*E04H 15/32* (2006.01)

(52) U.S. Cl. ..... 135/118; 135/99; 135/119; 135/120.4

(58) Field of Classification Search ..... 135/99, 135/118, 120.4, 121, 87; 248/530, 545; 52/2.25, 52/23, 83
See application file for complete search history.

(56) References Cited

U.S. PATENT DOCUMENTS

| | | | | |
|---|---|---|---|---|
| 204,425 | A * | 6/1878 | Daggett | 135/118 |
| 847,320 | A * | 3/1907 | Crane | 114/300 |
| 928,469 | A * | 7/1909 | Miles | 135/118 |
| 2,490,355 | A | 12/1949 | Hubbard | 189/90 |
| 3,139,163 | A | 6/1964 | Haller | 189/90 |
| 3,896,830 | A * | 7/1975 | Sharick | 135/93 |
| 4,098,041 | A | 7/1978 | Frye | 52/155 |
| 4,340,075 | A * | 7/1982 | Medeiros | 135/120.1 |
| 5,327,927 | A | 7/1994 | Oh | 135/117 |
| 5,461,833 | A | 10/1995 | Murray et al. | 52/155 |
| 5,477,876 | A | 12/1995 | Moss | 135/97 |
| 6,073,642 | A * | 6/2000 | Huang | 135/114 |
| 6,164,306 | A | 12/2000 | Townsend | 135/77 |
| 6,370,827 | B2 | 4/2002 | Chalich | 52/155 |
| 6,619,610 | B1 | 9/2003 | Genovese | 248/519 |

* cited by examiner

*Primary Examiner*—David Dunn
*Assistant Examiner*—Danielle Jackson
(74) *Attorney, Agent, or Firm*—R. Keith Harrison

(57) ABSTRACT

A covering structure with soil anchors is disclosed. The covering structure includes multiple support poles, a canopy provided on the support poles and multiple generally arcuate soil anchors attached to the canopy. Each soil anchor can be used to dig or burrow an anchor hole in sand or other loose soil in which the soil anchor is subsequently buried to anchor the canopy on the support poles.

20 Claims, 3 Drawing Sheets

COVERING STRUCTURE WITH SOIL ANCHORS

FIELD OF THE INVENTION

The present invention relates to temporary outdoor covering structures such as tents. More particularly, the present invention relates to a covering structure having generally arcuate soil anchors which can be covered by loose soil such as sand to facilitate secure anchoring of the structure in the soil.

BACKGROUND OF THE INVENTION

Covering structures such as tents are commonly temporarily deployed outdoors to shield persons from the sun or inclement weather conditions during a social or other outdoor event or to serve as a meeting hall, pavilion, barrack or the like. Typically, such covering structures include a flexible canopy of selected size and shape which is supported by multiple perimetric support poles at the respective corners or along the perimeter of the canopy and usually also by one or multiple central support poles at the center region or regions of the canopy. Anchor lines which are typically connected to the respective corners or to the perimeter of the canopy are attached to stakes which are driven into the ground. The anchor lines are typically tightened to maintain the canopy in a taut, spreaded configuration on the support poles.

One of the problems commonly associated with deploying a covering structure on a beach or other open area having sand or other loose soil is that the canopy is frequently subjected to high winds which tend to dislodge the stakes from the soil into which they are driven unless care is taken to drive the stakes deeply into the soil. This typically requires the use of hammers or other tools and renders difficult removal of the stakes from the soil during subsequent disassembly of the covering structure.

SUMMARY OF THE INVENTION

The present invention is generally directed to an outdoor covering structure having multiple soil anchors which can be buried or covered by sand or other loose soil to facilitate convenient and expeditious deployment and disassembly of the covering structure and yet effectively secure the deployed covering structure against strong winds. The covering structure includes a canopy having multiple support poles which rest on or are inserted in the ground and support a canopy in a functionally-deployed, spreaded, covering configuration. Multiple anchor lines are attached to the canopy and to respective, generally arcuate soil anchors each of which can be used to manually dig an anchor hole in the soil and then buried or covered with the soil. The soil anchors are effective to withstand high winds applied to the canopy and maintain the canopy in the deployed configuration during use.

BRIEF DESCRIPTION OF THE DRAWINGS

The invention will now be described, by way of example, with reference to the accompanying drawings, in which.

DETAILED DESCRIPTION OF THE INVENTION

Figure 1:
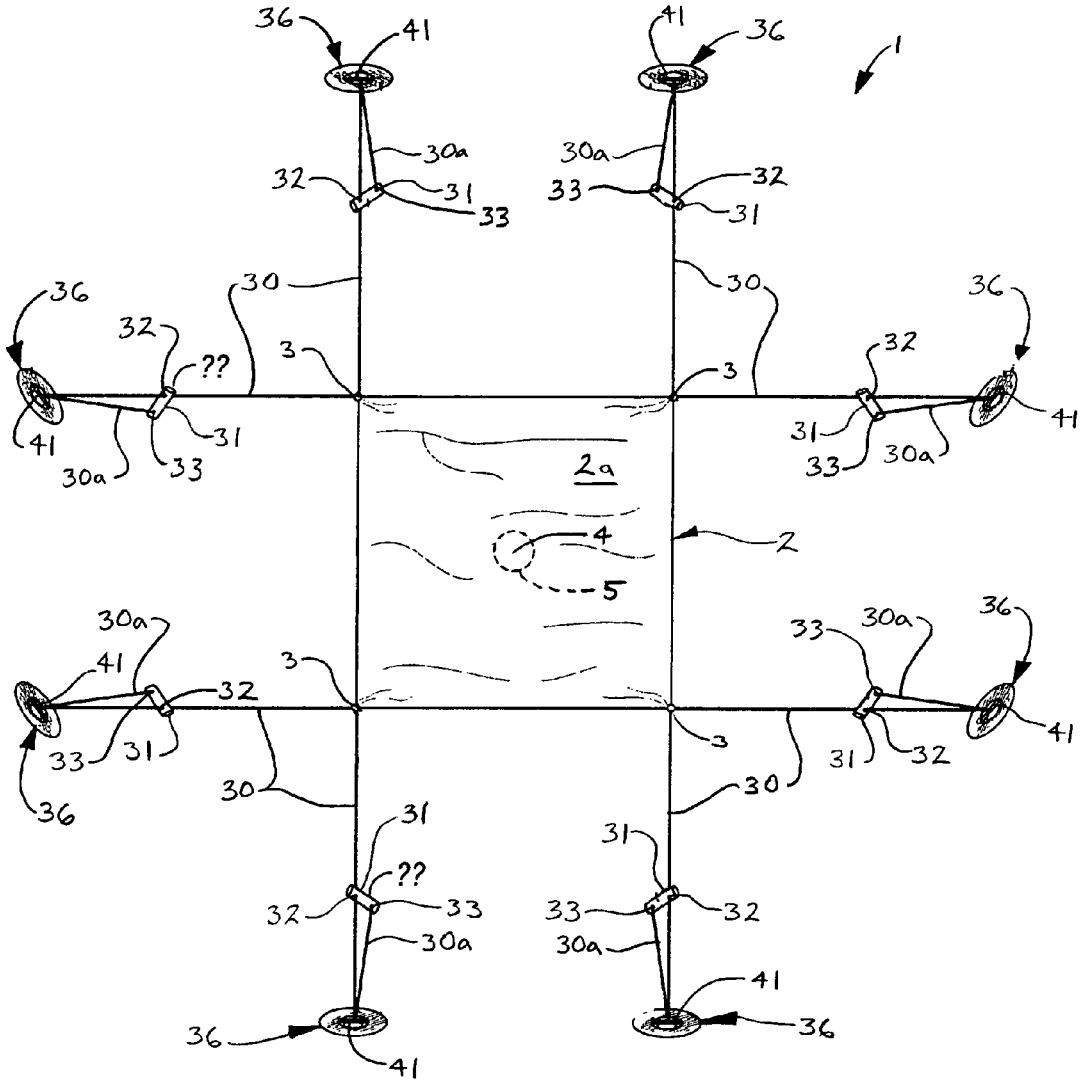
FIG. 1 is a top view of an illustrative embodiment of the covering structure with soil anchors of the present invention, with the canopy of the covering structure deployed in a spreaded configuration on the ground and the soil anchors attached to respective corners of the canopy via anchor lines preparatory to supporting the canopy on perimetric support poles and a central support pole (not illustrated), covering the soil anchors with sand or other loose soil (not illustrated) and tightening the anchor lines to complete deployment of the covering structure.
Figure 2:
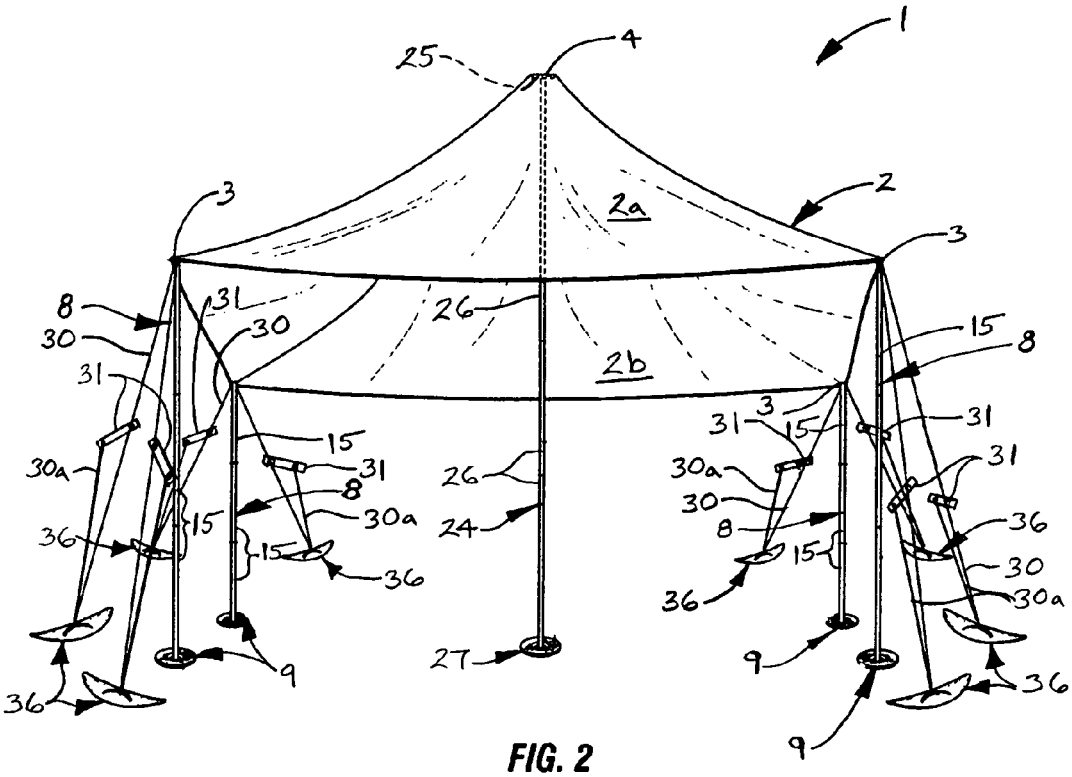
FIG. 2 is a front perspective view of the covering structure with soil anchors, with the covering structure deployed in a functional configuration.
Figure 3A:
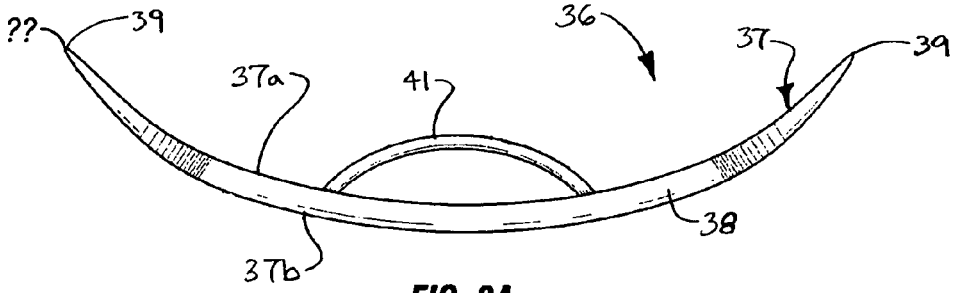
FIG. 3A is a side view of an illustrative soil anchor of the covering structure.
Figure 3B:
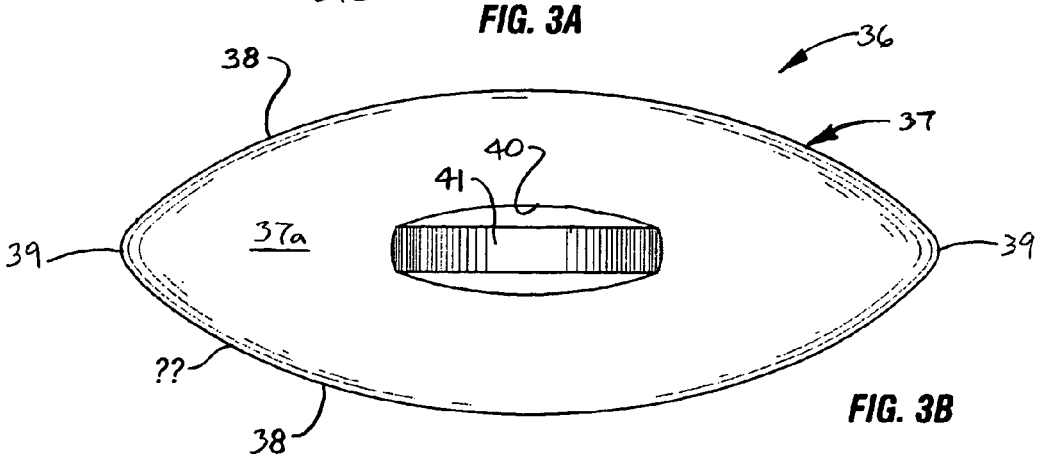
FIG. 3B is a top view of the soil anchor illustrated in FIG. 3A.
Figure 4:
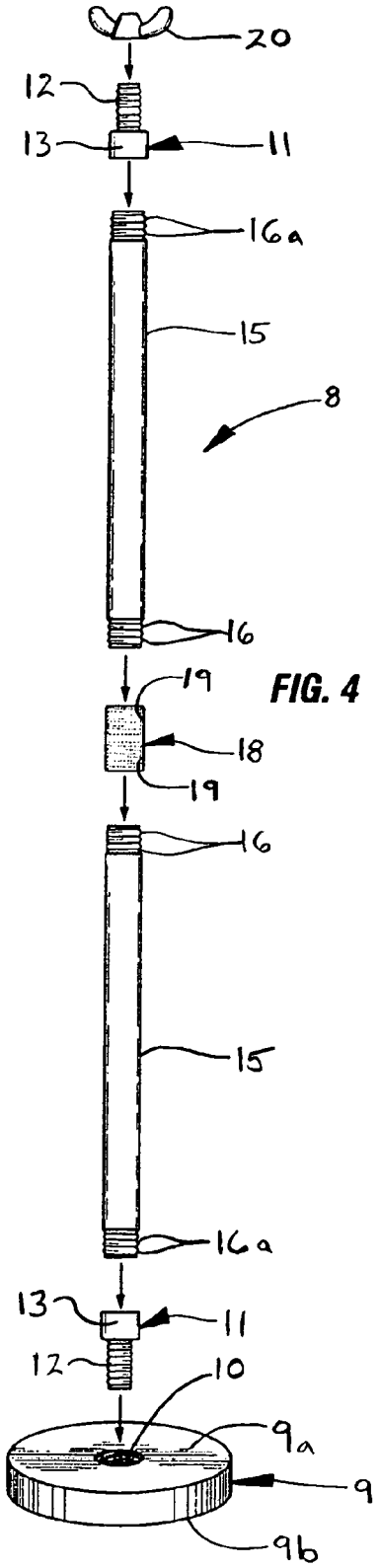
FIG. 4 is an exploded perspective view of an illustrative multi-segment perimetric support pole for the covering structure with soil anchors, which perimetric support pole can be assembled to a selected length in order to support a corner or perimeter of the canopy of the covering structure at a desired height.
Figure 5:
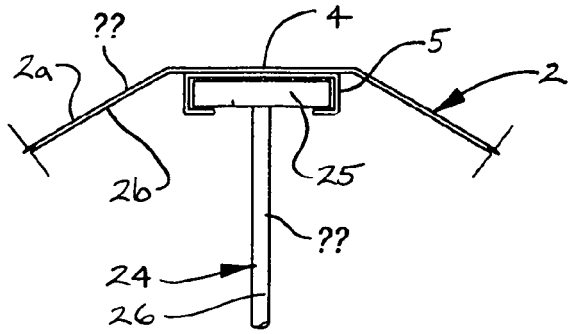
FIG. 5 is a cross-sectional view illustrating an illustrative technique for mounting the canopy on a central support pole for the canopy.

Referring to FIGS. 1-6 of the drawings, an illustrative embodiment of the covering structure with soil anchors, hereinafter covering structure, of the present invention is generally indicated by reference numeral 1 in FIGS. 1 and 2. The covering structure 1 is illustrated in the assembled, erected and functional configuration in FIG. 2 and includes a canopy 2 typically of flexible, durable fabric material such as nylon or polyester, for example. While the canopy 2 has a generally square or rectangular configuration in the embodiment illustrated in FIGS. 1 and 2, it is understood that the canopy 2 may have any selected size and shape such as an elongated rectangular shape, a circular shape, a triangular or polyhedral shape or an elongated, elliptical shape, in non-exclusive particular. The canopy 2 of FIGS. 1 and 2 has an upper surface 2*a*, a lower surface 2*b*, four canopy corners 3 and a canopy center 4. As illustrated in FIG. 5, a disk pocket 5, the purpose of which will be hereinafter described, is sewn or otherwise attached to the lower surface 2*b* of the canopy 2, at substantially the canopy center 4. An elastic band (not illustrated) may be provided around the mouth of the disk pocket 5 to allow the disk pocket 5 to recoil from an open to a closed position.

Figure 6:
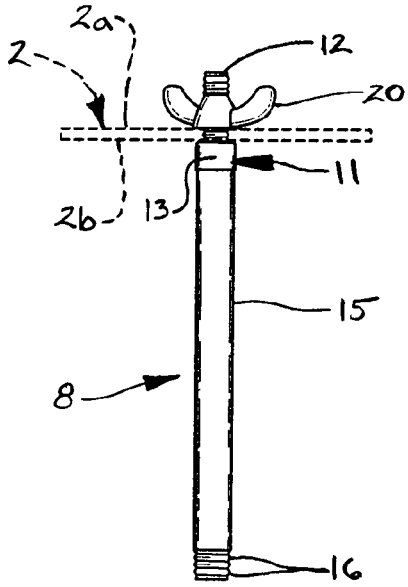
FIG. 6 is a side view of an upper pole segment of a perimetric support pole for the canopy, illustrating an illustrative technique for mounting the canopy on each perimetric support pole.

When the covering structure with soil anchors 1 is deployed in the erected, functional configuration, as illustrated in FIG. 2 and will be hereinafter described, multiple perimetric support poles 8 are erected at the respective canopy corners 3 and/or at selected spacings with respect to each other along the perimeter of the canopy 2 to support the canopy 2 above the ground (not illustrated). Each perimetric support pole 8 may be an elongated, continuous piece of material having a selected length to support the canopy 2 at a selected height above the ground. However, as illustrated in FIGS. 4 and 6, each perimetric support pole 8 preferably includes multiple, discrete, connected pole segments 15 each having a selected length. Each of the pole segments 15 is preferably wood, such as teak wood, for example, or may be any suitable alternative material such as metal or plastic, for example. Male threads 16, 16*a* are provided at respective ends of each pole segment 15. The male threads 16, 16*a* may be provided on the pole segment 15 in the form of a threaded metal (preferably brass) or plastic cap or insert, or alternatively, may be machined directly into the pole segment 15.

As illustrated in FIG. 4, a double female connector 18 may be used to connect adjacent pole segments 15 to each other in the perimetric support pole 8, or the pole segments 15 may be connected to each other using any suitable alternative connector (not illustrated) or technique known by those skilled in the art. The double female connector 18 may be a metal such as brass, for example, or alternatively, may be plastic or other suitable material. The double female connector 18 typically includes a pair of interiorly-threaded and oppositely-facing connector receptacles 19 which are joined to each other back-to-back and each of which is adapted to receive the male threads 16 on one end of the corresponding pole segment 15. Any desired number of pole segments 15 can be connected to each other in succession using multiple double female connectors 18 or other connector (not illustrated), depending on the desired length or height of the perimetric support poles 8. In each assembled perimetric support pole 8, a set of male threads 16*a* remains exposed on the extending or unattached end of each terminal pole segment 15. A threaded screw tip 11 may be provided on this exposed end of each terminal pole segment 15. The threaded screw tip 11 may include an interiorly-threaded female receptacle 13 which receives and threadably engages the exposed exterior male threads 16*a* on the pole segment 15 and a threaded shank 12 which extends from the female receptacle 13.

As further illustrated in FIG. 4, in the deployed covering structure 1 (FIG. 2), a pole support base 9, which may be circular, as shown, or alternative shape, typically supports the bottom end of each perimetric support pole 8 on the ground (not illustrated). The pole support base 9 may be wood, plastic, metal or other suitable material and has an upper face 9*a* and a lower face 9*b*. An interiorly-threaded disk opening 10 extends into the upper face 9*a* of the pole support base 9, at substantially the center of the upper face 9*a*. Accordingly, the perimetric support pole 8 is attached to the pole support base 9 by threading the threaded shank 12 of the threaded screw tip 11 which is provided at the bottom end of the perimetric support pole 8, into the disk opening 10. Alternatively, it is understood that the threaded screw tip 11 and the pole support base 9 may be omitted from the bottom end of the perimetric support pole 8, in which case the bottom end of the perimetric support pole 8 may rest on or be inserted in the ground to support the canopy 2 above the ground.

As illustrated in FIG. 6, the canopy 2 (illustrated in phantom) may be attached to the threaded screw tip 11 provided at the upper end of the perimetric support pole 8 using a conventional wing nut 20, for example. Accordingly, the threaded shank 12 of the threaded screw tip 11 at the upper end of the perimetric support pole 8 is initially extended through a shank opening (not illustrated) which is provided in the canopy 2 at each canopy corner 3 or through one of multiple, spaced-apart shank openings (not illustrated) which are provided along the perimeter of the canopy 2. The wing nut 20 is then threaded on the threaded shank 12 and tightened against the canopy 2, with the canopy 2 interposed between the lower surface of the wing nut 20 and the upper surface of the threaded female receptacle 13. It is understood that the canopy 2 may be attached to each perimeter support pole 8 using any suitable alternative technique known by those skilled in the art.

As illustrated in FIGS. 2 and 5, a central support pole 24 may support the canopy center 4 of the canopy 2 above the ground in the deployed covering structure with soil anchors 1. Depending on the size of the canopy 2, multiple central support poles 24 positioned at selected spacings with respect to each other may be used to support the central region or regions of the canopy 2, as deemed necessary. Each central support pole 24 may be an elongated, continuous piece of material having a selected length. Preferably, however, each central support pole 24 includes multiple, discrete pole segments 26 which may be similar in construction to the pole segments 15 and connected to each other using double female connectors 18 (FIG. 4) or other connecting elements known by those skilled in the art, as was heretofore described with respect to the perimetric support poles 8 of FIG. 4. A pole support base 27, which may be similar in construction to the pole support base 9 heretofore described with respect to the perimetric support poles 8, is threadably or otherwise attached to the bottom end of the central support pole 24 to support the lower end of the central support pole 24 on the ground. Alternatively, the pole support base 27 may be omitted from the central support pole 24, in which case the lower end of the central support pole 24 may be directly supported on or inserted in the ground.

As further illustrated in FIG. 5, a canopy support disk 25 may be threadably or otherwise attached to the upper end of the central support pole 24. The canopy support disk 25 is adapted to be inserted in the disk pocket 5 provided on the lower surface 2*b* of the canopy 2 to secure the canopy 2 on the central support pole 24 in the deployed covering structure with soil anchors 1.

As further illustrated in FIGS. 1 and 2, at least one, and preferably, a pair of anchor lines 30, each of which may be a rope or cord, for example, is attached at one end of each to each canopy corner 3 of the canopy 2, typically using a fastening ring (not illustrated), a clip (not illustrated) or any other suitable technique known by those skilled in the art. From the canopy 2, each anchor line 30 extends in a tight sliding friction fit through a handle opening 32 (FIG. 1) which extends through a corresponding tension adjusting handle 31. The anchor line 30 then extends in freely-sliding fashion through a corresponding soil anchor 36, which will be hereinafter described. An adjusting segment 30*a* of the anchor line 30 extends from the soil anchor 36 and is attached to the tension adjusting handle 31. The tension adjusting handle 31 may include an attachment opening 33 into which the extending end of the adjusting segment 30*a* of the anchor line 30 extends and is secured according to the knowledge of those skilled in the art. Accordingly, in the deployed covering structure 1, tension in the main segment of the anchor line 30, which extends between the soil anchor 36 and the canopy corner 3, can be tightened as desired by sliding the tension adjusting handle 31 upwardly on the anchor line 30, toward the canopy 2, or conversely, loosened by sliding the tension adjusting handle 31 downwardly on the anchor line 30, toward the soil anchor 36.

As illustrated in FIGS. 3A and 3B, each soil anchor 36 typically includes an elongated, generally arcuate anchor body 37 which may generally have the shape of an oblate spheroid when viewed from above, as shown in FIG. 3B, or from below. The anchor body 37 is preferably metal but may alternatively be a stiff, durable plastic or other material. As illustrated in FIG. 3A, the anchor body 37 has a generally concave upper surface 37*a* and a generally convex lower surface 37*b*, as well as curved side edges 38 which are continuous with at least one and preferably a pair of oppositely-extending tapered end portions 39, as illustrated in FIG. 3B. A typically elongated, elliptical anchor opening 40 may extend through substantially the center of the anchor body 37. Both ends of an elongated, curved anchor handle 41 are attached to the upper surface 37*a* of the anchor body 37 typically by molding, welding or other techniques known by those skilled in the art. The anchor handle 41 typically spans the longitudinal dimension of the anchor opening 40 and extends generally parallel to the longitudinal axis of the anchor body 37. One of the anchor lines 30 extends freely between the handle 41 and the anchor body 37 or anchor opening 40. During deployment of the covering structure with soil anchors 1 in an erected, functional position as will be hereinafter further described, each soil anchor 36 may be grasped at the handle 41 and one or both of the tapered end portions 39 used to dig or burrow an anchor hole (not illustrated) in sand or other loose soil. The soil anchor 36 is then placed in the anchor hole and covered with the dislodged soil to anchor the soil anchor 36 in the soil.

In use, the covering structure 1 is deployed in the erect, functional position typically on a beach or shore of a water body (not illustrated) or in some other location to provide shelter from the sun or inclement weather to users. Alternatively, the covering structure 1 may be used as a temporary meeting hall, pavilion, barrack or in any other application which is deemed appropriate. It will be appreciated by those skilled in the art that the covering structure 1 is adaptable to being deployed in any area having sand or other loose soil. The soil anchors 36 facilitate deployment of the covering structure 1 in areas having strong winds in spite of the loose nature of the soil by which the soil anchors are covered. As illustrated in FIG. 1, the canopy 2 is typically initially spread out on the ground with each anchor line 30 or pair of anchor lines 30 attached to each corresponding canopy corner 3 and each soil anchor 36 attached to the corresponding anchor line 30. Each perimetric support pole 8 is assembled to the desired height by connecting a selected number of the pole segments 15 to each other, after which the pole support base 9 is threadably attached to bottom end of the perimetric support pole 8 and the upper end of the perimetric support pole 8 is attached to the corresponding canopy corner 3 typically using the wing nut 20, as was heretofore described with respect to FIG. 4. Accordingly, the perimetric pole support bases 9 support the respective perimetric support poles 8 on the ground, and the perimetric support poles 8 support the respective canopy corners 3 of the canopy 2 at the selected height above the ground.

The central support pole 24 is assembled to the desired height by attaching the pole segments 26 to each other, and the pole support base 27 is attached to the bottom end of the central support pole 24. As illustrated in FIG. 5, the canopy support disk 25 is attached to the upper end of the central support pole 24 and the central support pole 24 is erected on the ground, with the pole support base 27 supporting the central support pole 24 on the ground. As further illustrated in FIG. 5, the canopy support disk 25 is inserted in the disk pocket 5 to secure the canopy 2 to the central support pole 24. Accordingly, the central support pole 24 supports the canopy center 4 of the canopy 2 above the ground.

Next, the anchor lines 30 are anchored to the ground by buying the soil anchors 36 in the soil or covering the soil anchors 36 by the soil. This is accomplished by extending the anchor lines 30 outwardly from the canopy corners 3, grasping the anchor handle 41 of each soil anchor 36, digging or burrowing an anchor hole (not illustrated) using one or both of the tapered end portions 39 (FIG. 3B) of the soil anchor 36, placing the soil anchor 36 in the anchor hole, and covering the soil anchor 36 with the loose or dislodged soil. The soil can be packed over and around each soil anchor 36 to firmly plant each sand anchor 36 in the soil. As illustrated in FIG. 1, the buried or covered soil anchors 36 attached to each canopy corner 3 via the respective anchor lines 30 are preferably disposed at a generally 90-degree angle with respect to each other. Each anchor line 30 may be tightened, as deemed necessary, by sliding the tension adjusting handle 31 upwardly on the anchor line 30, toward the canopy 2, thereby progressively lengthening the adjusting segment 30*a* of the anchor line 30 and correspondingly shortening the main portion of the anchor line 30 which extends between the soil anchor 36 and the canopy 2. Conversely, each anchor line 30 may be loosened, as deemed necessary, by sliding the tension adjusting handle 31 downwardly on the anchor line 30, away from the canopy 2. Accordingly, each anchor line 30 is firmly anchored in the soil and maintains the canopy 2 in a taut, spreaded position on the perimetric support poles 8 and central support pole 24, thus preventing wind buffeting of the canopy 2 and enabling the covering structure with soil anchors 1 to withstand high winds applied to the canopy 2.

The covering structure with soil anchors 1 can be disassembled, as desired, by removing the sand or other soil from the soil anchors 36 to expose the soil anchors 36; removing the perimetric support poles 8 from the canopy corners 3 of the canopy 2; removing the central support pole 24 from the canopy center 4 of the canopy 2 by removing the canopy support disk 25 (FIG. 5) from the disk pocket 5; disassembling the perimetric support poles 8 and central support pole 24; and folding the canopy 2. It will be appreciated by those skilled in the art that the covering structure 1 can be easily stored in a closet or other enclosure when not in use.

While the preferred embodiments of the invention have been described above, it will be recognized and understood that various modifications can be made in the invention and the appended claims are intended to cover all such modifications which may fall within the spirit and scope of the invention.

Having described my invention with the particularity set forth above, I claim:

1. A covering structure comprising:

a plurality of support poles;

a canopy carried by said plurality of support poles;

a plurality of generally arcuate soil anchors carried by said canopy; and wherein each of said plurality of generally arcuate soil anchors comprises a generally arcuate anchor body having at least one tapered end portion, a generally concave surface, a generally convex surface and an elongated and curved anchor handle having spaced-apart first and second ends attached to said generally concave surface of said anchor body.

2. The covering structure of claim 1 wherein said canopy has a generally polygonal shape having a plurality of canopy corners and said plurality of support poles is disposed at said plurality of canopy corners, respectively.

3. The covering structure of claim 1 wherein each of said plurality of support poles comprises a plurality of pole segments connected to each other.

4. The covering structure of claim 1 further comprising a plurality of pole support bases carried by said plurality of support poles, respectively.

5. The covering structure of claim 1 wherein said plurality of support poles comprises a plurality of perimetric support poles and at least one central support pole.

6. The covering structure of claim 5 further comprising a disk pocket carried by said canopy and a canopy support disk carried by said at least one central support pole and contained in said disk pocket.

7. The covering structure of claim 6 further comprising a plurality of pole support bases carried by said plurality of perimetric support poles and said at least one central support pole, respectively.

8. The covering structure of claim 1 wherein said at least one tapered end portion comprises a pair of tapered end portions.

9. A covering structure comprising:

a plurality of support poles;

a canopy carried by said plurality of support poles;

a plurality of anchor lines carried by said canopy;

a plurality of soil anchors carried by said plurality of anchor lines, respectively, each of said plurality of soil anchors comprising a generally elongated, arcuate anchor body having opposite tapered end portions and a generally concave surface and a generally convex surface and an elongated, elliptical anchor opening extending through said anchor body and an elongated and curved anchor handle having spaced-apart first and second ends attached to said generally concave surface of said anchor body and said anchor handle extending in the same direction as a longitudinal axis of said anchor opening; and wherein each of said plurality of anchor lines extends freely between said anchor handle and said anchor opening of a corresponding one of said plurality of soil anchors.

10. The covering structure of claim 9 wherein each of said plurality of support poles comprises a plurality of pole segments connected to each other.

11. The covering structure of claim 10 further comprising at least one double female connector connecting adjacent ones of said plurality of pole segments together in each of said plurality of support poles.

12. The covering structure of claim 10 further comprising a plurality of pole support bases carried by said plurality of support poles.

13. The covering structure of claim 10 wherein said plurality of support poles comprises a plurality of perimetric support poles and at least one central support pole.

14. The covering structure of claim 13 further comprising a disk pocket carried by said canopy and a canopy support disk carried by said at least one central support pole and contained in said disk pocket.

15. The covering structure of claim 9 further comprising a plurality of tension adjusting handles carried by said plurality of anchor lines, respectively.

16. A covering structure comprising:

a plurality of perimetric support poles and at least one central support pole;

a canopy carried by said plurality of perimetric support poles and said at least one central support pole;

a plurality of anchor lines carried by said canopy;

a plurality of soil anchors carried by said plurality of anchor lines, respectively, each of said plurality of soil anchors comprising a generally elongated, arcuate anchor body having opposite tapered end portions, a generally concave surface, a generally convex surface opposite said generally concave surface and an elongated, elliptical anchor opening extending through said anchor body, and an elongated and curved anchor handle having spaced-apart first and second ends attached to said generally concave surface and said anchor handle extending in the same direction as a longitudinal axis of said anchor opening, and wherein a corresponding one of said plurality of anchor lines extends between said anchor handle and said anchor opening; and a plurality of elongated tension adjusting handles carried by said plurality of anchor lines, respectively and a handle opening and an attachment opening extending through each of said tension adjusting handles in spaced-apart relationship to each other and wherein said corresponding one of said plurality of anchor lines extends from said canopy and through said handle opening, between said anchor handle and said anchor opening of a corresponding one of said plurality of soil anchors and through said attachment opening respectively, of a corresponding one of said tension adjusting handles.

17. The covering structure of claim 16 wherein each of said plurality of perimetric support poles and said at least one central support pole comprises a plurality of pole segments connected to each other and further comprising a plurality of pole support bases carried by said plurality of perimetric support poles and said at least one central support pole, respectively.

18. The covering structure of claim 17 further comprising at least one double female connector connecting adjacent ones of said plurality of pole segments together.

19. The covering structure of claim 18 further comprising a disk pocket carried by said canopy and a canopy support disk carried by said at least one central support pole and contained in said disk pocket.

20. The covering structure of claim 16 wherein each of said plurality of tension adjusting handles is cylindrical.

* * * * *